US005147705A

United States Patent [19]

Ta-Shun et al.

[11] Patent Number: 5,147,705

[45] Date of Patent: Sep. 15, 1992

[54] ELASTIC BAND

[76] Inventors: Lin Ta-Shun; Chen Kuan-Yu, both of Room 602, No. 49, Sec. 3, Chung-Shan N. Road, Taipei, Taiwan

[21] Appl. No.: 621,831

[22] Filed: Dec. 4, 1990

[51] Int. Cl.[5] ..... B32B 3/28

[52] U.S. Cl. ..... 428/167; 428/121; 428/124; 428/130; 428/172; 428/192; 2/336; 2/DIG. 11

[58] Field of Search ..... 428/167, 172, 33, 57, 428/156, 192, 906, 77, 121, 124, 130; 2/240, 336, 199, DIG. 11; 57/3, 21

[56] References Cited

U.S. PATENT DOCUMENTS 4,626,247 12/1986 Frankel ..... 604/312

*Primary Examiner*—Ellis P. Robinson
*Assistant Examiner*—Donald J. Loney
*Attorney, Agent, or Firm*—Morton J. Rosenberg; David I. Klein

[57] ABSTRACT

This invention relates to an improved elastic band and in particular to one including a first portion with a plurality of longitudinal serrated projections and a second portion with smooth surface, whereby articles with a cylindrical contour may be conveniently secured together without worrying about the separation of the articles.

5 Claims, 8 Drawing Sheets

ELASTIC BAND

BACKGROUND OF THE INVENTION

It is found that the prior art elastic band on the market easily loses its elasticity thereby shortening the service life of the article to which it is affixed. Further, most elastic bands apply a relatively tightening force to the body of a person hence even blocking the blood circulation of the person. In addition, the elastic band cannot be used in binding large articles together unless it is made larger in size.

Therefore, it is an object of the present invention to provide an improved elastic band which may obviate and mitigate the above-mentioned drawbacks.

SUMMARY OF THE INVENTION

This invention relates to an improved elastic band.

It is the primary object of the present invention to provide an improved elastic band which is widely applicable to connection between two articles especially with a cylindrical contour.

It is another object of the present invention to provide an improved elastic band which is simple in structure.

It is still another object of the present invention to provide an improved elastic band which is easy to be affixed to an article.

It is still another object of the present invention to provide an improved elastic band which is economic to produce.

It is a further object of the present invention to provide an improved elastic band which can be served for a long time.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
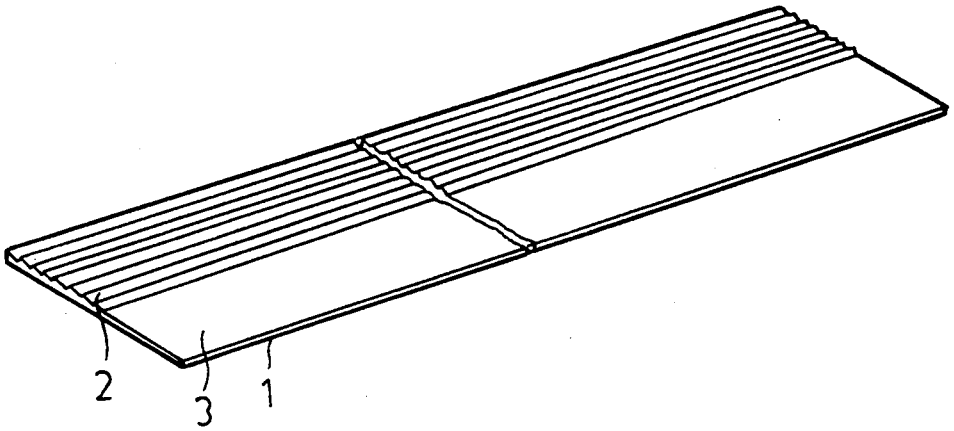
FIG. 1 is a developed view of an improved elastic band according to the present invention.
Figure 2:
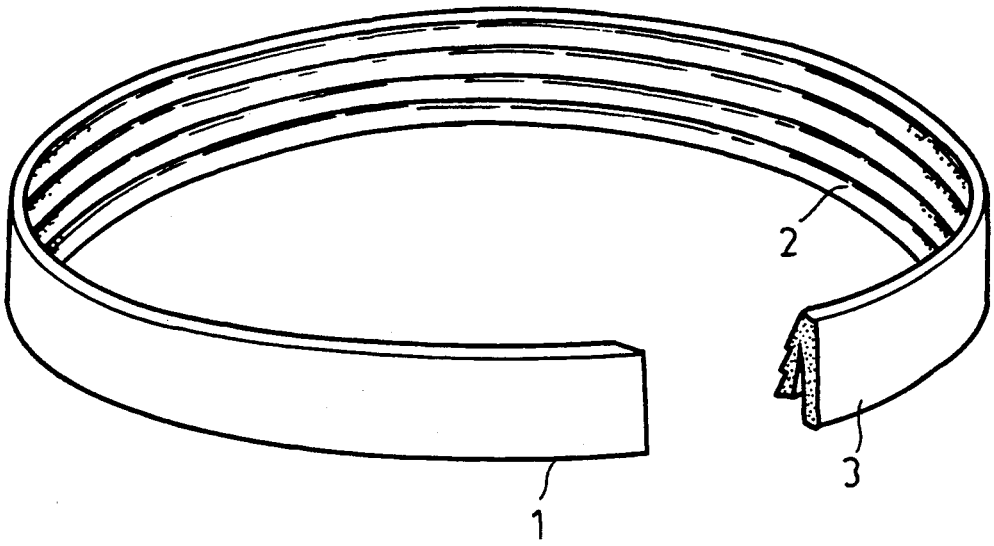
FIG. 2 is a perspective view of the improved elastic band.
Figure 3:
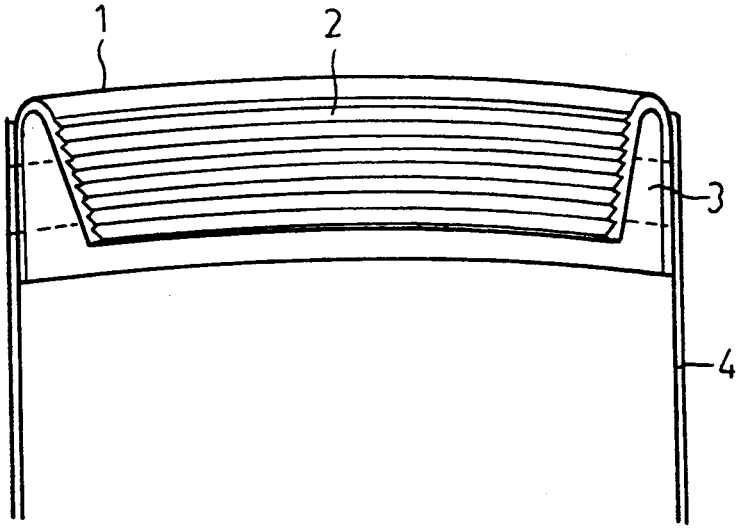
FIG. 3 shows the connection between the improved elastic band and a cylindrical member.

With reference to the drawings and in particular to FIG. 1 thereof, the improved elastic band 1 according to the present invention comprises a first portion 2 extending in a longitudinal direction with a plurality of longitudinal serrated projections and a second portion 3 extending in a longitudinal direction with smooth surface. The elastic band 1 is preferably made of tough and soft material. The first portion 2 angularly connects the second portion 3 at one side (see FIG. 2) thereby forming an inverted-V shaped member. However, the first portion 2 and the second portion 3 may be made integrally or separately. Further, the elastic band may be provided with the first portion only so that the elastic band may be directly affixed to the desired article.

Figure 4:
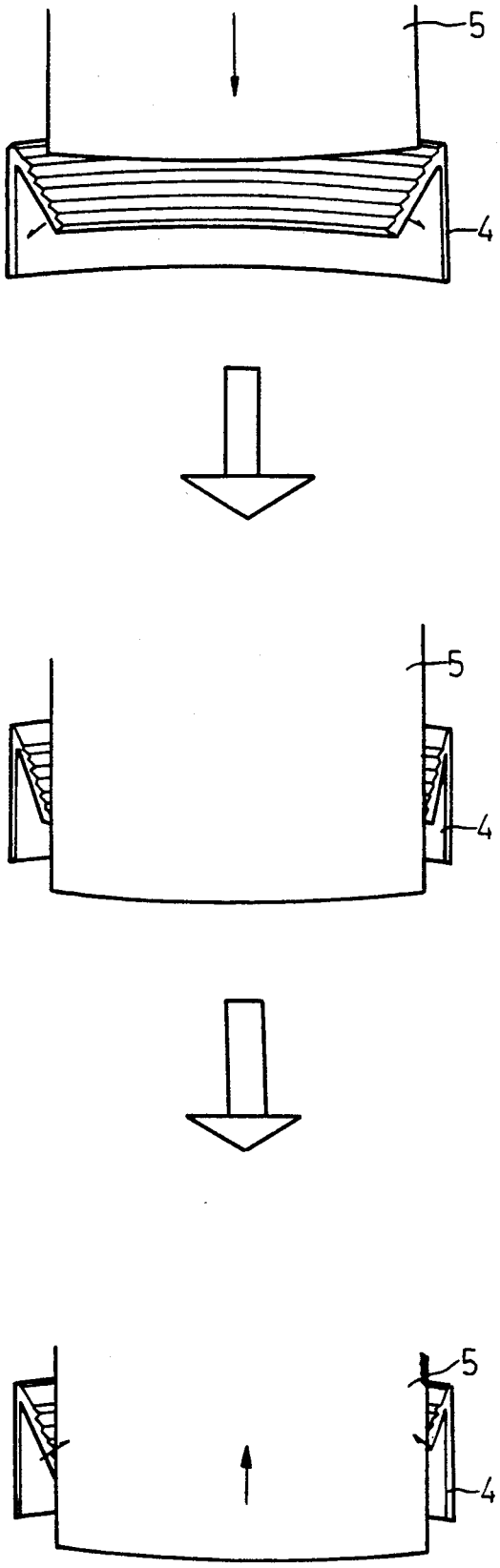
FIG. 4 shows the principle of the improved elastic band.

When the elastic band 1 is used to connect two cylindrical members 4 and 5, simply affix the second portion 3 of the elastic band 1 to the cylindrical member 4 with the first portion 2 at the inner side of the first portion 3. Then, as the cylindrical member 5 is put into the cylindrical member 4, the first portion 3 of the elastic band 1 will be slightly pressed inwards to adapt to the cylindrical member 5 thereby producing a tightening force on the cylindrical member 5. Further, the serrated projections of the first portion 2 of the elastic band 1 will prevent the cylindrical member 5 from slipping downwards thus joining the members 4 and 5 together (see FIG. 4).

Figure 5:
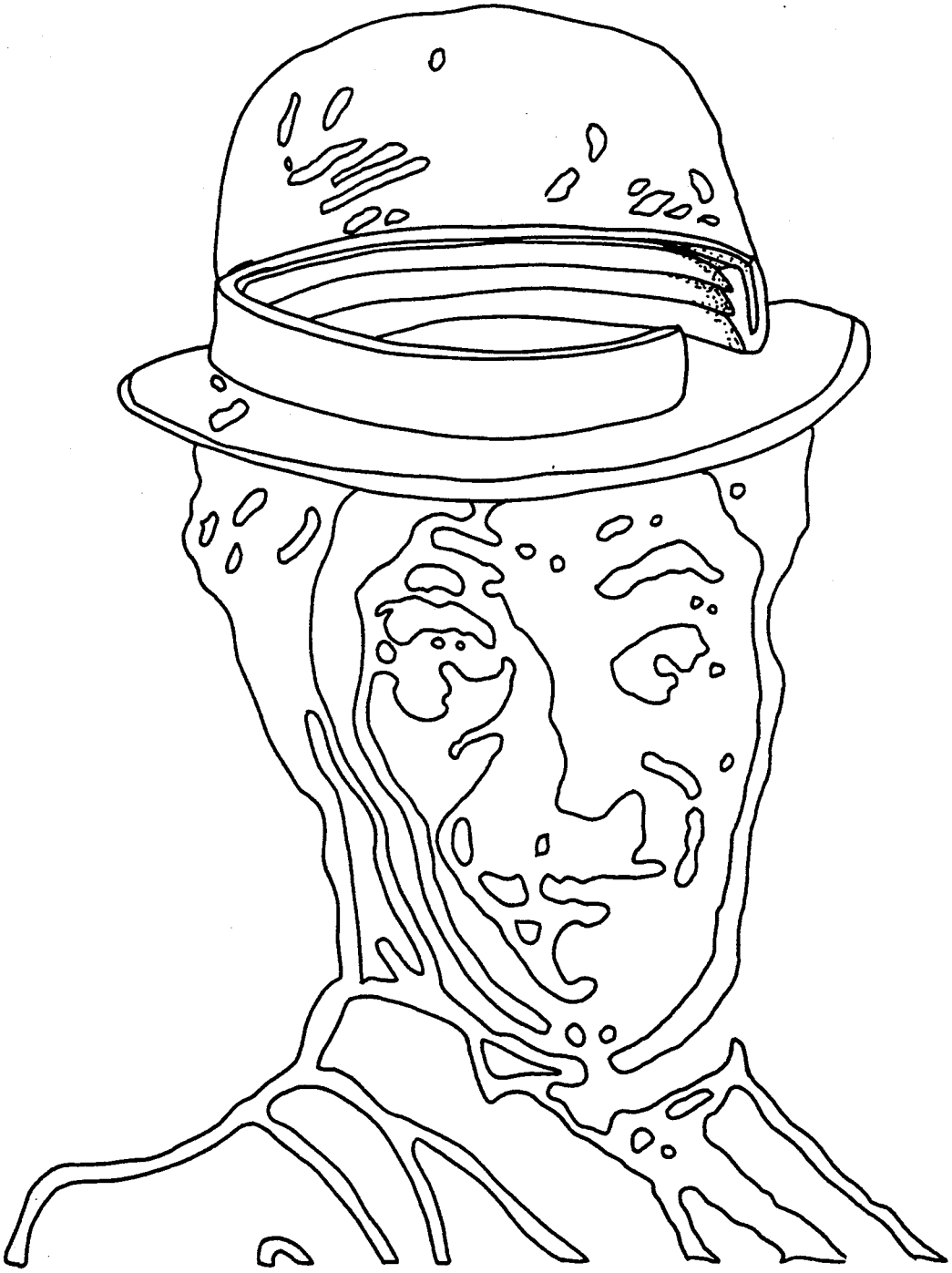
FIG. 5 shows an application of the improved elastic band to a hat.

FIG. 5 shows another preferred embodiment of the present invention, in which the elastic band is applied to a hat and is possessed of a V-shape instead of an inverted V-shape. When the hat is put on to the head of a person, the second portion 3 of the elastic band 1 will be slightly pressed inwards thereby producing a tightening force against the head. In addition, the serrated projections of the first portion 2 of the elastic band will keep the hat in place.

Figure 6:
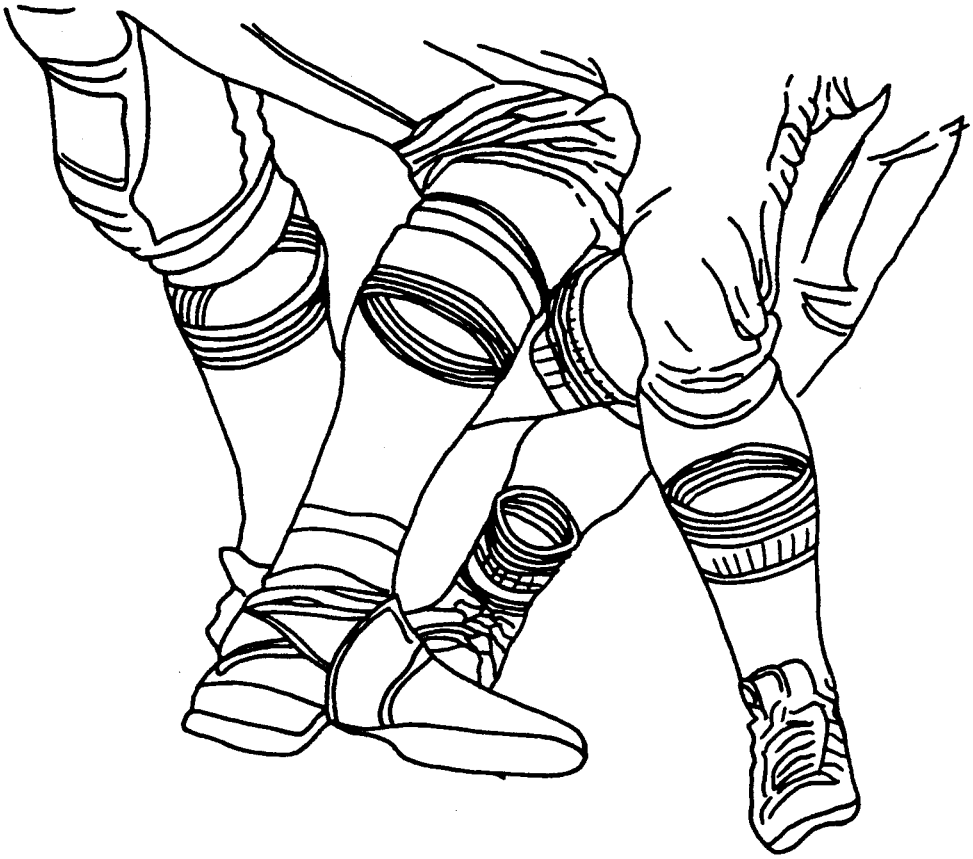
FIG. 6 shows an application of the improved elastic band to stockings.
Figure 7:
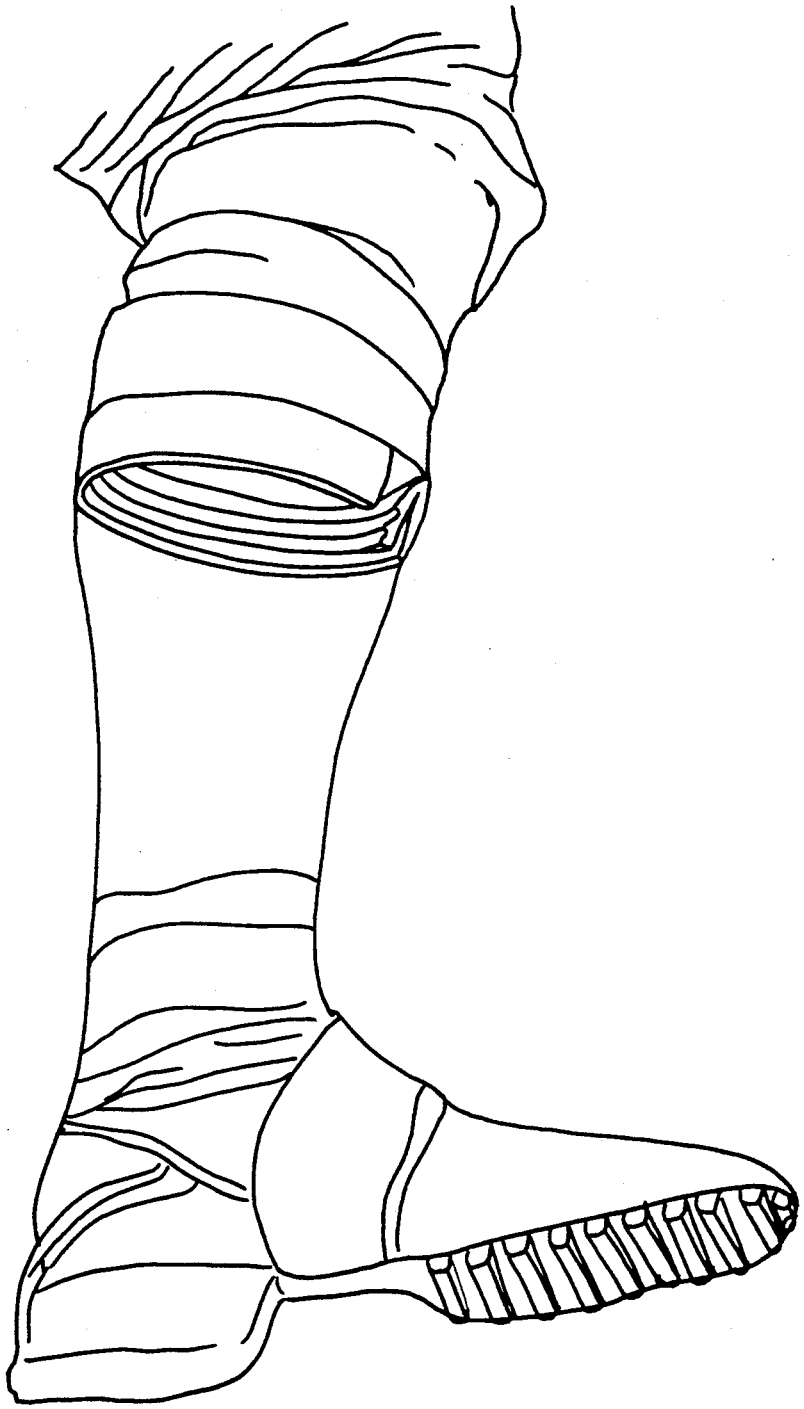
FIG. 7 is an enlarged fragmentary view of FIG. 6.

FIGS. 6 and 7 show still another preferred embodiment of the present invention wherein the elastic band is applied to stockings. The stocking provided with the elastic band may keep closely on the calf without blocking the blood circulation.

Figure 8:
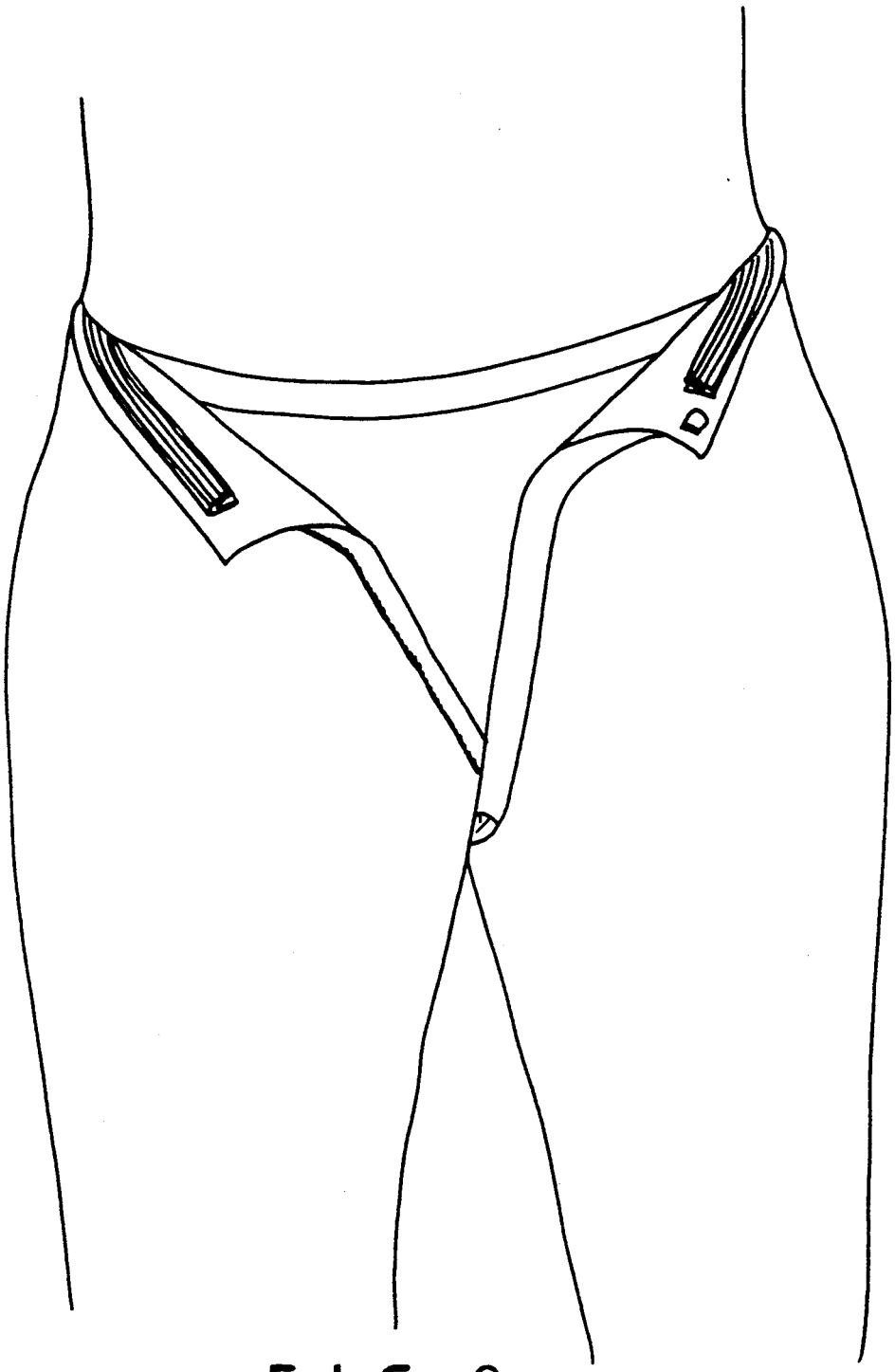
FIG. 8 shows an application of the improved elastic band to a pair of trousers.

FIG. 8 shows how the present invention is used with a pair of trousers, wherein the elastic band may be slightly adjusted to adapt to the waist of the user when he eats his fill.

It should be noted, however, that the present invention is applicable to the connection for various articles especially the clothing. Further, in addition to the replacement of the conventional elastic band, the present invention may provide size compensation for various cylindrical members.

The application of the present invention is too wide to be mentioned and cannot be all enumerated here in detail. It is understood that the present disclosure is made by way of example only and that numerous changes in the detail of construction and the combination of parts may be resorted to without departing from the spirit and scope of the invention as hereinafter claimed.

I claim:

1. An elastic band for releasable securement to an object comprising:

a first member extending in a longitudinal direction having opposing first and second continuous surfaces, said first surface being substantially planar in contour and said second surface having a plurality of projections protruding therefrom for contiguous interface with said object; and, a second member extending in a longitudinal direction having first and second continuous surfaces, said second member having a longitudinal edge angularly affixed to a longitudinal edge of said first member.

2. An elastic band as recited in claim 1 wherein said plurality of projections are aligned in substantially parallel rows extending in said longitudinal direction on said second surface of said first member.

3. An elastic band as recited in claim 2 wherein said first member and said second member are integral.

4. An elastic band, comprising:

a first member extending in a longitudinal direction having opposing first and second continuous surfaces, said first surface being substantially planar in contour and said second surface having a plurality of projections protruding therefrom; and, an elastic member being angularly connected to said first member extending in a longitudinal direction having a planar first surface, a second surface, and a plurality of projections protruding from said second surface.

5. An elastic band as recited in claim 4 wherein said plurality of projections are aligned in substantially parallel rows extending in said longitudinal direction on said second surface of said first member.

* * * * *